US006345578B1

(12) United States Patent
Pabst

(10) Patent No.: US 6,345,578 B1
(45) Date of Patent: Feb. 12, 2002

(54) DOUBLE-ACTING TROLLEY TO SUPPORT ONE-CABLE INSTALLATIONS AND IN PARTICULAR CHAIR LIFTS AND CABIN LIFTS

(75) Inventor: Otto Pabst, Rio Pusteria (IT)

(73) Assignee: High Technology Investments B.V. (NL)

( * ) Notice: Subject to any disclaimer, the term of this patent is extended or adjusted under 35 U.S.C. 154(b) by 0 days.

(21) Appl. No.: 09/665,795

(22) Filed: Sep. 20, 2000

(30) Foreign Application Priority Data

Sep. 24, 1999 (IT) ..... BZ99A0044

(51) Int. Cl.[7] ..... B61B 12/12
(52) U.S. Cl. ..... 104/112; 104/173.1
(58) Field of Search ..... 104/112, 113, 104/114, 173.1, 173.2, 199, 183; 105/453

(56) References Cited

U.S. PATENT DOCUMENTS 871,431 A * 11/1907 Mozingo ..... 104/173.2
2,741,372 A * 4/1956 Richards ..... 104/173.1
3,347,172 A * 10/1967 Sowder ..... 104/173.1
4,957,047 A * 9/1990 Feuz et al. ..... 104/204

FOREIGN PATENT DOCUMENTS

EP 0216340 A2 * 9/1985

* cited by examiner

*Primary Examiner*—S. Joseph Morano
*Assistant Examiner*—Frantz F. Jules
(74) *Attorney, Agent, or Firm*—Shlesinger, Fitzsimmons & Shlesinger

(57) ABSTRACT

A double-acting trolley for a one-cable installation support for chair lifts and cabin lifts, includes a bearing member mounted in a swinging manner to a one-cable installation support, and supporting two equalizers respectively below and above the one cable and with each equalizer having at least two rollers engaged with the cable. Also, above and below the cable the respective two equalizers are articulated centrally and respectively to supports each of which is articulated in an elastically damped manner at one end to the bearing member.

5 Claims, 1 Drawing Sheet

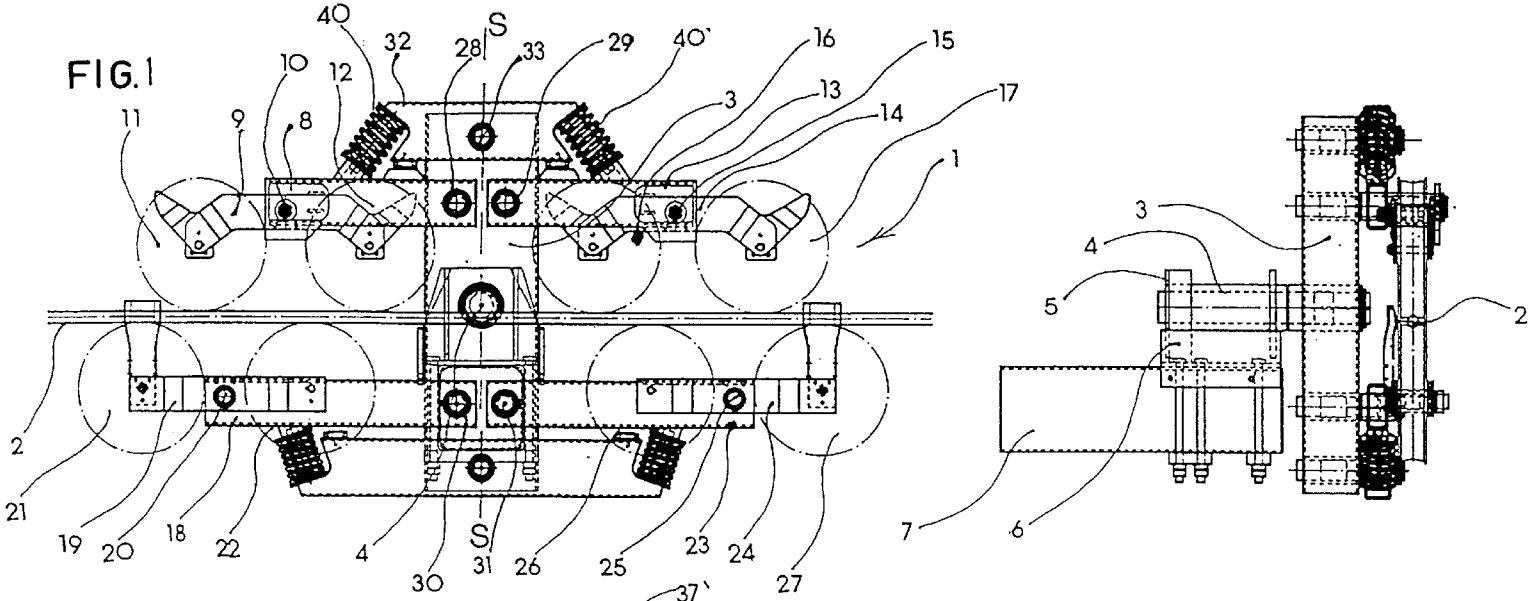
FIG. 1
FIG. 3
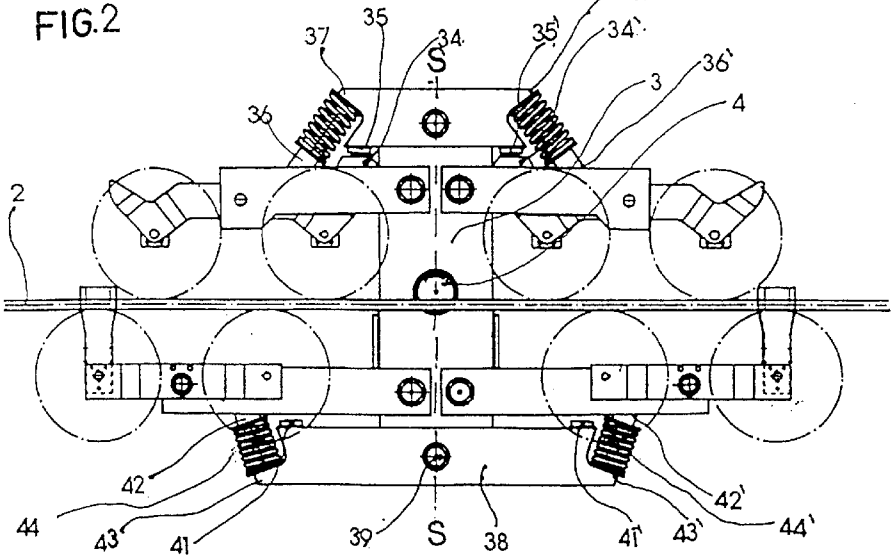
FIG. 2

DOUBLE-ACTING TROLLEY TO SUPPORT ONE-CABLE INSTALLATIONS AND IN PARTICULAR CHAIR LIFTS AND CABIN LIFTS

BACKGROUND OF THE INVENTION

The present invention relates to a double-acting trolley to support one-cable installations and in particular chair lifts and cabin lifts.

In chair and cabin lifts the means of conveyance in the form of chairs and cabins are born by a single cable, i.e. a bearing & hauling cable which winds around the reversing pulleys in the stations. Depending on the terrain and the length of the path the single cable must in turn be supported or retained by support and guide means. The latter are usually fitted with rolls or rollers which are bearing if the cable passes over them and retaining if the cable passes under them. The passage of each roller over the connection, i.e. the cable clamp, involves cable jumping the intensity of which depends on the angle of deviation of the cable on the roller among other things. This jumping causes the cable to vibrate and increases the risk of fleeting of the bearing & hauling cable.

There are known trolleys which have for example two bearing equalizers each with two rollers and fastened in a rotating manner to a bearing bar. In this case the vibrations are sufficiently damped and therefore the trolley is subject among other things to less wear and creates less disturbance for the passengers because the passage is smoother. But this solution is not suited to the fullest reduction of fleeting since an effective anti-derailing measure is not provided for the cable.

One of the purposes of the present invention is therefore passage of a bearing & hauling cable through a trolley with simultaneous increase of safety against fleeting and to propose a fully equalized trolley capable of effectively absorbing shocks and vibrations and equipped with an arrangement against cable derailing.

Another purpose of the present invention is to adopt a safety measure in case of failure of one of the associated equalizers where there are at least two roller bearing equalizers.

Another purpose is the provision of a trolley which could be used as a pre-assembled unit and would be employable both for bearing and retention of the bearing & hauling cable.

SUMMARY OF INVENTION

These purposes are achieved in accordance with the present invention by a trolley with characteristics in accordance with the following description.

By articulating each equalizer support to a bearing member of an installation support opposite one end of the equalizer support the latter can rotate under the load of the bearing & hauling cable around its articulation point against the striker in a damping material on the bearing member to absorb vibrations, blows, shocks et cetera. Preferably rotation of the equalizer support is opposed by a spring acting virtually in the direction opposite that of rotation.

In the case of two equalizer supports arranged specularly to each other with respect to a vertical plane virtually perpendicular to the bearing & hauling cable, the two springs are opposed on one side by respective equalizer supports and on the other side by a common equalizer member articulated to the bearing member. In this manner, in the

BRIEF DESCRIPTION OF THE DRAWING

FIG. 1 shows a trolley in accordance with the present invention from the suspension side of a means of conveyance with respect to the bearing & hauling cable.

FIG. 2 shows a view from the side opposite the suspension side with respect to the bearing & hauling cable, and FIG. 3 shows a view of the trolley in accordance with the present invention in the direction of running on the cable.

BRIEF DESCRIPTION OF THE PREFERRED EMBODIMENT

With reference to the figures reference number 1 indicates as a whole a trolley for a bearing & hauling cable installation and in particular for a chair or cabin lift. A bearing & hauling cable 2 extending between two stations (not shown) runs thereon in a known manner.

The trolley 1 comprises a rising or upwardly extending bearing member 3 to which is fastened a supporting pin 4. Through support 5 and a stand 6 the pin 4 is received by a bearing member 7 designed to he fastened to the top of a support i.e. a stand of the installation.

The trolley 1 consists of a first support element 8 born by a first equalizer 9 articulated or joined as at 10 to support element 8 and bearing two rollers 11, 12. The trolley 1 also consists of a second upper support clement 13 born by a second upper equalizer 14 joined or articulated at 15 thereto and bearing two rollers 16, 17. The trolley 1 is then made up also of a first lower support element 18 born by a first lower equalizer 19 articulated at 20 thereto and bearing two rollers 21, 22 and a second lower support 23 bearing a second equalizer 24 articulated at 25 thereto and bearing two rollers 26, 27. The first upper support element 8 is articulated at 28 and the second upper support 13 at 29 to the rising bearing member 3 so that the two articulations 28, 29 are arranged specularly with respect to a vertical symmetry plane perpendicular to the cable S—S. Likewise the first and second lower support elements 18, 23 are articulated at 30 and 31 respectively to the rising bearing member 3 specularly to the same symmetry plane S—S. The lower support elements 18, 23 are sized respectively so that the rollers 21, 22 and 26, 27 respectively arc staggered with respect to the upper rollers 11, 12 and 15, 17 respectively.

At the upper apex of the rising member 3 extends partially above the upper support 8 and symmetrically to the upper support 13 a common equalizer member 32 articulated at 33 to the bearing member 3 with articulation axis lying in the symmetry plane S—S. The upper support 8 and the support 13 respectively have a striker 34, 34' designed to mate respectively with shims 35 and 35' respectively of the lower surface of the free ends of the common equalizer member 32 so that the striker 34, 34' and the shim 35, 35' strike together in a damping manner. From the upper surface of the support 8 and the upper surface of the support 13 projects a portion of pins 36 and 36' respectively directed respectively toward the free ends 37, 37' of the common equalizer member 32 so as to compress between them a spring 40, 40' respectively.

To the lower apex of the rising bearing member 3 is articulated at 39 a common equalizer member 38 also having shims 41, 41' respectively designed to strike on the lower surface of the supports 18, 23 opposed by a spring 44, 44' respectively extending between a portion of pin 42, 42' and the end 43, 43' of the equalizer member 38.

The trolley in accordance with the present invention achieves among others the following advantages.

The elastically opposed equalizers sprung in the direction of the cable ensure avoidance of fleeting of the cable from the pulley and at the same time smooth passage of the cable with little vibration.

Resting of two opposing springs (40,40';44,44') on one and the same equalizer permits intervention of one of them in case of breakage of the other to ensure greatest safety for the cable guide because pressure of the cable guide rollers is transmitted automatically through the equalizer (32,38) to the equalizer with a faulty spring.

The trolley in accordance with the present invention can be supplied as a preassembled unit to make installation faster and can be employed either for bearing or retention of the single cable.

What is claimed is:

1. Double-acting trolley for a bearing and hauling cable of a one-cable installation support comprising, a bearing member (3) articulated in a swinging manner to the one-cable installation support and two equalizers each having thereon at least two cable guide rollers, and characterized in that above and below the bearing & hauling cable (2) are arranged the two equalizers (9, 14) and (19, 24), respectively, each of which equalizers is articulated centrally thereof (10, 15) and (20, 25), respectively, to a support element (8, 13) and (18, 23), respectively, articulated in an elastically damped manner at one end thereof to the bearing member (3), and to each of the upper and lower apices of the bearing member (3) is articulated (33, 39 respectively) a common equalizing member (32, 38 respectively) extending symmetrically to a symmetry plane (S—S partially above the support elements (8, 13 and 18, 23 respectively) and the ends of which (37, 37' and 42, 23' respectively) are loaded elastically with respect to the supports (8, 13 and 18, 23 respectively).

2. Trolley in accordance with claim 1 characterized in that the upper support elements (8, 13) and lower support elements (18, 23) respectively are articulated (28, 29) and 30, 31) to the bearing member (3) in symmetrical specular manner with respect to a plane perpendicular to the bearing & hauling cable (2).

3. Trolley in accordance with claim 1 characterized in that the support elements (8, 13 and 18, 23 respectively) are loaded with respect to the bearing member (3) through springs (40, 40' and 44, 44' respectively).

4. Trolley in accordance with claim 3 characterized in that the length of the upper supports elements (8, 13) is different from that of the lower support elements (18, 23) to stagger the roller positions in one equalizer relative to the roller positions of the other equalizer (19, 24).

5. Trolley in accordance with claim 3 characterized in that upon breakage of one of the springs (40, 44) to ensure the fullest cable guidance safety because the pressure of the cable guide rollers is transmitted automatically to the common equalizer (32, 38) that has a faulty spring.

* * * * *